US005921206A

United States Patent [19]

Sams

[11] Patent Number: 5,921,206

[45] Date of Patent: Jul. 13, 1999

[54] HEATER FOR PROCESS FLUIDS

[75] Inventor: Gary W. Sams, Tulsa, Okla.

[73] Assignee: National Bank Company, Houston, Tex.

[21] Appl. No.: 09/128,483

[22] Filed: Aug. 4, 1998

[51] Int. Cl.[6] ..... F22B 23/06

[52] U.S. Cl. ..... 122/367.1; 165/163

[58] Field of Search ..... 122/44.1, 49, 53, 122/56, 188, 201, 235.17, 235.23, 367.1, 367.2; 165/163

[56] References Cited

U.S. PATENT DOCUMENTS

| | | | |
|---|---|---|---|
| 3,211,134 | 10/1965 | Loebel | 122/149 |
| 3,871,444 | 3/1975 | Houser et al. | 165/163 |
| 4,226,283 | 10/1980 | Furukawa et al. | 165/163 |
| 4,421,062 | 12/1983 | Padilla, Sr. | 122/367.1 |
| 5,377,661 | 1/1995 | Farver | 122/367.1 |

*Primary Examiner*—Teresa Walberg
*Assistant Examiner*—Gregory A. Wilson
*Attorney, Agent, or Firm*—Head, Johnson & Kachigian

[57] ABSTRACT

A system for heating a process fluid having an elongated horizontal shell filled with a heat transfer liquid, an elongated horizontal firetube and an elongated horizontal process coil of heat conducting pipe through which process fluid passes, the firetube being positioned within a lower interior portion of the shell and the process coil being positioned within an upper interior portion of the shell above the firetube and a baffle system between the firetube and the process coil forming an elongated higher elevation up flow passageway and a spaced apart elongated lower elevation down flow passageway so that when heat is supplied to the firetube convection flow of heat transfer liquid is continually channeled from the shell lower portion through the up flow passageway into the shell upper portion and past the process coil and channeled from the shell upper portion through the down flow passageway into the shell lower portion.

11 Claims, 3 Drawing Sheets

HEATER FOR PROCESS FLUIDS

REFERENCE TO PENDING APPLICATIONS

This application is not related to any pending applications.

REFERENCE TO MICROFICHE APPENDIX

This application is not referenced in any microfiche appendix.

BACKGROUND OF THE INVENTION

A frequently employed method of heating a process fluid is by use of an indirect water bath heater. By "process fluid" means a liquid or gas employed in chemical, petroleum or other processing or manufacturing industries.

The expression "indirect water bath heater" means that the heater system employs a quantity of water or other heat transfer liquid that is heated, and heat from the liquid then heats the process fluid. Thus, the term "indirect" means that heat is not applied directly to the process fluid, or directly to a container in which the process fluid is contained, but is applied indirectly through a water or other liquid bath.

A water bath heater has advantages over a direct fired heater, a significant advantage being that an indirect heater provides more uniform temperature control with reduced likelihood that the process fluid will be either overheated or underheated at any instant of time. Further, the use of an indirect heater system reduces the likelihood of explosions or fires that can occur when a combustible process fluid, such as a oil or gas, is inadvertently overheated.

While these type of systems are referred to as "indirect water bath heaters", the expression "water" is used generically to mean any heat transfer liquid. Many indirect heater systems use glycol or a mixture of water and glycol as the heat transfer medium. The systems work essentially the same irrespective of the particular type of heat transfer liquid that is utilized.

The commonly known indirect water bath heater is typically in the form of a vessel, usually an elongated cylindrical horizontal vessel, although other vessels shapes are sometimes employed. A water bath heater vessel is usually referred to as a "shell". A burner tube, usually referred to as a "firetube" or "U-tube" is positioned in a lower portion of the shell and, when the shell is typically elongated and horizontal, the firetube is also elongated and horizontal. A most common method of employing a firetube in an indirect water bath heater is to utilize a long tube having an inlet at one end of the shell, the tube extending substantially the length of the shell and turning in a U-shaped fashion to an exit at the same end of the shell. Exterior of the shell a burner is affixed to the inlet end of the tube, the burner typically including a nozzle that injects gas mixed with forced or naturally inspirated air that produces a blast of hot gases that are moved into the firetube through the tube inlet. Hot gases travel the length of the firetube and reverse direction at the far end and return to the outlet. At the outlet, exterior of the shell, an exhaust stack is typically provided so that the products of combustion are exhausted to the atmosphere.

Located in an upper portion of the shell, above the firetube, is a process coil formed of loops of heat conductive pipe that extends back and forth horizontally through the full length of the shell. An inlet and an outlet of the process coil extends through a shell end wall. A process fluid, either liquid or gas, to be heated is passed into the process coil to flow back and forth through the coil loops within the upper portion of the shell. The process fluid is heated by heat transferred from the liquid heat transfer medium.

This type of indirect water bath heater has been used successfully for many years. The invention described herein provides an improved method, system and apparatus by which convective currents are established within the heat transfer medium of an indirect water bath heater to more efficiently transfer heat from a firetube to a process coil.

BRIEF SUMMARY OF THE INVENTION

The invention provides a method, system and apparatus for heating a process fluid. The method includes the step of heating a heat transfer liquid also referred to as a bath, within an elongated horizontal vessel, also called a shell, by means of an elongated heater, also called a firetube, positioned within a lower portion of the shell. Process fluid is circulated through an elongated generally horizontal looped process coil of heat conducting pipe positioned within an upper portion of the shell and submersed within the heat transfer liquid. This invention provides an elongated baffle supported within the shell elevationally between the firetube and the process coil to form opposed longitudinal first and second flow passageways at opposed longitudinal edges of the baffle. The baffle is inclined to the horizontal in a vertical plane taken perpendicular to the length of the shell so that the first passageway is elevationally higher than the second passageway. This elevational difference causes heated transfer liquid to flow upwardly through the first, higher elevational elongated passageway into the upper interior portion of the vessel and cooled heat transfer liquid to flow downwardly through the second, lower elevational elongated passageway into the lower portion of the shell.

The invention relies upon the density differential that develops between the bath liquid around the firetube and the looped process coil positioned within the upper portion of the shell. The baffle which is substantially horizontal lengthwise, that is, end-to-end, is positioned between the firetube and the process coil. By inclining the baffle at a slight angle relative to the horizontal in a side-to-side relationship, the angle being taken in a plane perpendicular to the longitudinal axis of the shell, a significant and important improvement is made in the pattern of heat transfer fluid circulation between the lower interior portion and the upper interior portion of the shell. An incline of as little as 2.5° results in beneficial improvement of the circulation rate of heat transfer liquid within the shell. The baffle preferably extends, in side-to-side relationship, essentially across the entire shell to thereby provide relatively narrow width elongated flow passageways at opposed sides of the baffle since excessively wide flow passages between the edge of the baffle and the shell reduces the desired circulation.

With a properly installed baffle the heat transfer liquid as heated by the burner side of a firetube rises to the bottom side of the baffle. The slight side-to-side incline of the baffle directs this hot liquid towards the first, or elevational higher longitudinal passageway. Since this hot heat transfer liquid is lighter than the liquid on top of the baffle, the hot liquid rises through the first, elevationally higher longitudinal passageway and into the upper portion of the vessel in the area surrounding the process coil. Simultaneously the process coil continually extracts heat from the bath fluid within the upper portion of the vessel. As the bath fluid is cooled in the upper portion of the vessel it settles onto the top side of the baffle. The slight incline of the baffle directs the cooler heat transfer liquid towards the opposite longitudinal passageway, that is, the lower elevation passageway at the opposite side of the baffle. Since the heat transfer liquid is heavier in this area than the hotter liquid below the baffle, the cooler liquid settles through the second longitudinal passageway into the lower portion of the shell. This organized circulation develops rapidly once the firetube is heated, that is, once a flame is established within the firetube, and the circulation continues as long as the firetube is heated. Modeling of the process as disclosed herein using fluid dynamic software has indicated that the heat transfer rate from the firetube to the process fluid flowing through the process coil can be improved by as much as nine percent (9%) in some applications.

Heat transfer performance can be further improved by improved burner fire rate control. Traditional bath temperature controllers used to adjust the burner fire rate supplied to a firetube of an indirect bath heater are pneumatic and behave in an on/off operational mode. An on/off method of burner control significantly reduces the efficiency of a heater. In this invention, a thermocouple is positioned in the bath, preferably at the centerline of the heater, on the higher elevated side of the baffle, to respond quickly to changes in heat transfer liquid temperature. A throttling type valve is used to control flow of gas to the burner in response to the thermocouple. The burner firing rate regulation optimally approaches a steady state. By reducing burner cycling and evening out the burner firing rate, the firetube heat transfer efficiency can be improved by up to five percent (5%).

The invention as summarized to this point employs a single heater. The invention is also applicable wherein the shell includes more than one firetube in the lower portion thereof, such as two or three firetubes. In heaters with two or three firetubes two baffles are preferably employed to establish improved circulation patterns of the heat transfer liquid. In a heater with two firetubes a baffle is installed over each firetube. Each baffle is inclined relative to the horizontal in a plane taken perpendicular the length of the firetubes with the baffles being slightly lower in the center of the shell. The two baffles do not touch but provide a longitudinal center passageway opening between them that is elevationally lower than opposed longitudinal passageways at the outer edges of the baffles. The center, elevationally lower passageway functions as an outlet passageway for the upper portion of the vessel so that cooler heat transfer liquid settles downwardly through the central passageway into the bottom portion of the shell while the heat transfer fluid heated in the lower portion of the shell flows upwardly through the opposed, higher elevation longitudinal passageways at opposed walls of the shell. Since the two firetubes may be controlled and operated independently, the use of two baffles permit beneficial circulation to develop when a single firetube is used.

In heaters with three firetubes, each of an elongated U-shaped configuration positioned in a lower portion of an elongated cylindrical shell, the center firetube is installed vertically while the two outer firetubes may be angled slightly. Two baffles are also used but they are angled slightly upwardly in the center—opposite the angular arrangement as discussed when two firetubes are used. The baffles do not touch in the center, but provide a longitudinal center, elevationally higher passageway that permits hot heat transfer liquid from the lower portion of the shell to rise through the center passageway into the upper portion of the shell for heating the process fluid coils. The cooler fluid from the upper portion of the shell settles to the outside of the two inclined baffles and flows downwardly through opposed elevationally lower longitudinal passageways at opposed edges of the two baffles. Thus, two independent convection circulations of the heat transfer liquid are established and benefits are obtained even if only a single firetube is heated.

The method, system and apparatus as described herein provides advantages over existing indirect water bath heaters, some of the advantages being:

(a) the use of baffles between a process fluid coil and firetubes in an elongated cylindrical shell prevent percolation of bath fluid and helps establish organized, steady state bath circulation patterns;

(b) the bath circulation rate responds quickly to changes in process fluid flow rates and firetube firing rates;

(c) a single properly located thermocouple measuring the bath temperature can be used to reliably control the burner firing rate;

(d) improved burner control helps achieve improvement in the heater's thermal efficiency by reducing the tendency for the burner to cycle;

(e) burner cycling is reduced thereby resulting in lower firetube wall temperatures, decreased temperature-induced stresses, higher firetube heat transfer efficiencies, reduced fuel consumption, increased burner reliability and reduced swings in the process outlet temperature;

(f) the baffle increases heat transfer rates from a firetube to a coil by establishing forced convective heat transfer in addition to the convective heat transfer that normally occurs;

(g) the improved steady state operation of a heater makes the application of improved bath or process temperature controls possible;

(h) an inclined baffle creates flow patterns that reduce the tendency for scale or rust deposits to accumulate on top of the firetube; and (i) the use of a baffle or baffles in an indirect water bath heater results in improved heat transfer liquid flow patterns that permit the use of an improved throttling-type temperature controller to thereby approach a steady-state burner firing rate, thus improving the thermal efficiency of the heater's firetubes.

A better understanding of the invention, including advantages thereof, will be obtained from the following description of the preferred embodiments, taken in conjunction with the attached drawings and claims.

DESCRIPTION OF THE DRAWINGS

FIG. 1 is, in the main, typical of known types of gas fired heaters but has an important improvement in the form of a baffle positioned between the firetube and the process fluid coils.

DETAILED DESCRIPTION OF THE PREFERRED EMBODIMENTS

Figure 1:
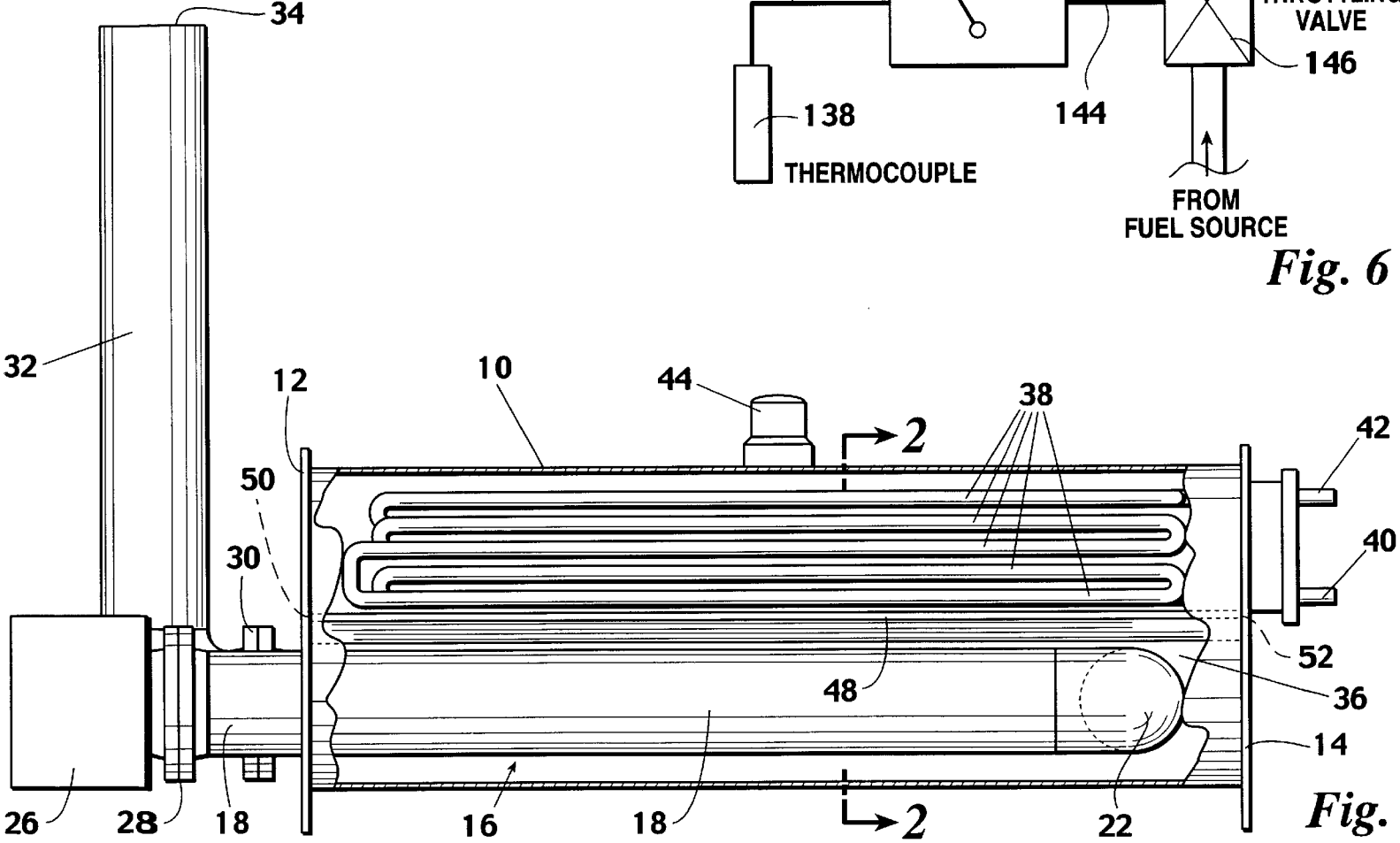
FIG. 1 is an elevational cross-sectional view of an indirect water bath heater for heating process fluids employing a cylindrical horizontal shell and showing the sidewall of the shell cutaway to reveal the interior contents.
Figure 2:
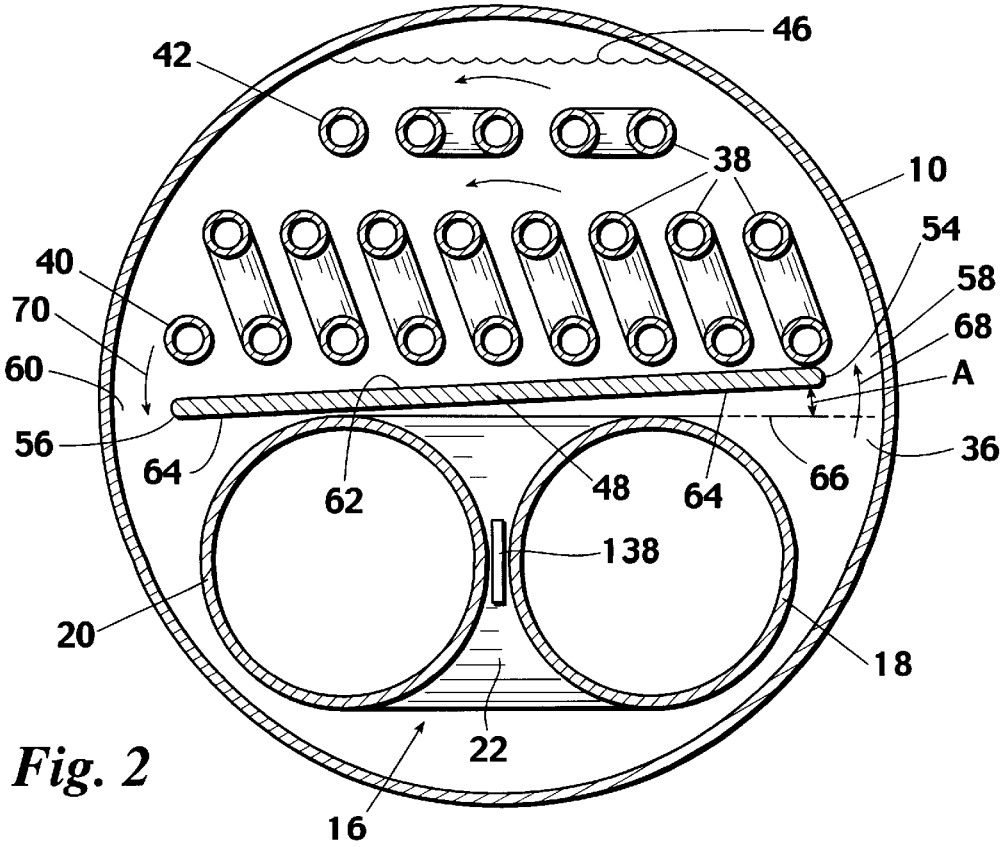
FIG. 2 is an elevational cross-sectional view taken along the line 2—2 of FIG. 1 showing a U-shaped heater tube positioned within a lower portion of a shell, an elongated process coil positioned in an upper interior portion of the shell, and in cross-section, a flow directing baffle positioned intermediate the firetube and the process coil.

Referring to FIGS. 1 and 2, the basic elements making up an indirect water bath heater of the type presently used is illustrated. An elongated horizontal cylindrical shell 10 has a first end 12 and second end 14. Positioned within the interior of shell 10, in the lower portion thereof, is an elongated firetube generally indicated by the numeral 16 that typically is in the form of a U-shaped tube having a burner leg 18 and a stack leg 20. The firetube burner leg 18 and stack leg 20 are interconnected within the interior of the vessel adjacent the second end 14 by a U-shaped portion 22.

The combustion process may use either a gaseous or liquid fuel depending on price and availability. Referring to FIG. 1, a gas burner (not shown) installed in a flame arrestor housing 26 passes heated products of combustion through flange 28 to burner leg 18 of firetube 16. Heat is provided by burning a gaseous fuel with combustion air is inspirated into flame arrestor 26. With liquid fuels, the flame arrestor 26 and gas burner are replaced by an oil-fired burner and combustion air fan (not shown). The oil burner would be mounted on flange 28 and the flame would pass into burner leg 18.

Stack leg 20 (not seen in FIG. 1) exits the shell end wall 12 and is connected to a flange 30 which in turn is connected to an exhaust stack 32 which communicates at its outer upper end 34 with the atmosphere. Thus, the firetube 16 consists of elements 18 through 34 as a typical firetube system by which heat is applied to a liquid heat transfer medium 36 contained within shell 10. The details of elements 16 through 34 are not specifically a part of this invention since these details are well known and can vary considerably. The important elements of the heater system of this invention are those within the interior of shell 10, that is, specifically heater burner leg 18 and stack leg 20 as interconnected by U-shaped portion 22.

Positioned within an upper portion of the interior of shell 10 is an elongated closed loop formed of heat conductive pipe forming a process coil 38. Process coil 38 includes an inlet pipe 40 and outlet pipe 42. The process coil provides the system for transferring heat from heated transfer medium 36 within shell 10 to process fluids flowing through the coil. Process fluids can be liquids or gases and in the petroleum industry in many instances the process fluid is of crude oil which is heated in the system for further treatment and processing, however, the particular processing fluid, whether a liquid or a gas, is not relevant to the invention as the invention relates to an indirect system for heating a process fluid irrespective of its particular nature.

Figure 3:
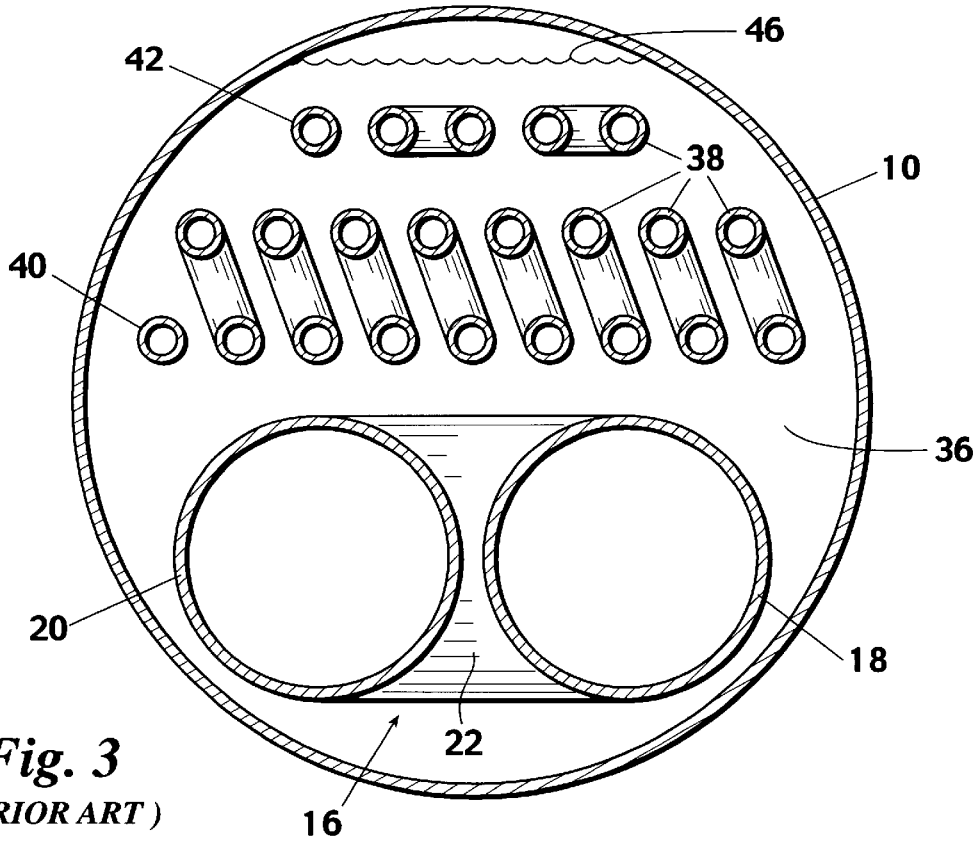
Fig. 3 ( PRIOR ART )
FIG. 3 is a cross-sectional elevational view as in FIG. 2 showing the state of the prior art, that is, showing a heater of the type in FIG. 1 that is illustrative of process fluid heaters in use today.

FIG. 1 as described to this point and FIG. 3 together constitutes an illustration of the prior art. A fill hatch 44, as seen in FIG. 1, is illustrative of a way by which heat transfer medium 36 can be added to the interior of the shell. The heat transfer medium 36 may be typically water or glycol or a water/glycol combination all as customarily employed in the petroleum industry in indirect heaters. However, the specific heat transfer liquid can vary according to the particular application and the particular heat transfer liquid is also not an element of the invention.

FIGS. 1 and 3 show a system by which a process fluid is indirectly heated by heat supplied to a heat transfer liquid within the interior of a shell 10 by a firetube 16 that is in the form of a U-shaped tube. The upper surface 46 of heat transfer liquid is seen in FIG. 3 shows that the interior of shell 10 is completely filled or at least substantially filled with the heat transfer liquid. It is important that the height of heat transfer liquid within the shell be sufficient to at least substantially cover process coil 38.

Referring to FIG. 3, illustrative of the prior art, it can be seen that when hot gases flow into burner leg 18, move through U-shaped portion 22 and returns through stack leg 20 that heat therefrom is conveyed to heat transfer liquid 36 and from the heat transfer liquid to process fluid flowing within process coils 38. Process coils 38 typically enter and exit heater shell 10 at the end thereof opposite the firetube, as illustrated in FIG. 1, and whereas FIGS. 1 and 3 suggest a single loop of the process coil instead of a single loop several parallel paths, each containing two or more passes through heater shell 18 may be employed.

Referring specifically to FIG. 3, it can be seen that the heat transfer from the flame producing hot gases that flow into the system in burner leg 18 depends on a variety of heat transfer methods. The heat transfer process starts with the combination of radiant and forced convective transfer from combustion to the wall of firetube 18 and to a lesser degree to the wall of stack leg 20. Heat is transferred from the firetube walls, that is, from legs 18 and 20 to heat transfer liquid 36 primarily by natural convection. Natural convection relies on the temperature difference between the heat transfer surface and the heat transfer liquid, that is, the temperature of the exterior surface of legs 18 and 20 and the temperature of the bath liquid 36. Therefore, as the bath 36 is heated the transfer rate from the firetubes 18, 20 will decrease. Heat is transferred from the bath liquid 36 to the process coils 38 by natural convection. In this case, as the temperature of the heat transfer bath increases the transfer rate to coils 38 also increases. Heat transfer from the walls of process coils 38 to process fluid flowing within the process coils is always forced convective heat transfer. The rate of heat transfer from the flame to the process fluid within process coils 38 is almost always controlled by the natural convective transfer rate from the heater tubes 18, 20 to process coils 38. To satisfy the heat demand of the process fluid flowing through coils 38, coils 38 are engineered to provide the required surface area based on a constant, steady state temperature of bath 36. In normal operation, a constant bath temperature is impossible to achieve because the burner combustion rate that supplies products of combustion to burner leg 18 is controlled by the temperature of bath 36. As the burner is fired the temperature of bath 36 surrounding firetube 18 begins to slowly increase. At the same time, the temperature of bath 36 surrounding process coils 38 is being cooled. Since the firetube 18, 20 is located below process coils 38 a significant density differential begins to develop between the transfer medium 36 around the firetube 18, 20 and the process coils 38. At periodic intervals, the cooler, heavier heat transfer liquid in the bath surrounding process coils 38 settles downwardly within shell 10, displacing the warmer, lighter heat transfer fluid surrounding firetubes 18, 20. This percolation of the fluid bath 38 creates wide swings in the bath temperature thus making a steady state bath temperature the exception rather than the norm. The state of the art heater as illustrated in FIG. 3 thus exemplifies a system in which the flow paths of movement of the heat transfer medium or bath 36 within the shell is uncontrolled and therefore disorganized.

The present invention utilizes and relies upon the density differential that develops between the bath fluid 36 surrounding the firetube 18, 20 compared to that of the bath temperature around process coils 38 and establishes a consistent organized convective flow path pattern within the interior of shell 10 so that the transfer of heat from the firetubes 18, 20 to process coils 38 is substantially more uniform and consistent. To achieve this result, as illustrated in FIG. 2, and also illustrated in FIG. 1, a baffle 48 is inserted elevationally between the heater exemplified by firetube 18, 20 in the lower interior portion of shell 10 and process coils 38 positioned in the upper interior portion of the shell. Baffle 48 is essentially horizontal, that is, it extends parallel to both the firetube 18, 20 and the horizontally deployed process coils 38 in an end wise relationship between shell first end 12 and second end 14. As shown in FIG. 1 baffle 48 has opposed ends 50 and 52, the first end 50 being in contact with or at least adjacent to the interior of first end 12 of shell 10 and the baffle second end 52 is in contact with or at least adjacent to shell interior second end 14. Baffle 48 has opposed longitudinal edges 54 and 56 (See FIG. 2), the baffle being of a width less than the internal diameter of shell 10 so that the first edge 54 is spaced away from the interior wall of shell 10 and, in like manner, the second edge is spaced away from the opposite interior wall of shell 10. The spacing of edges 54 and 56 thereby provide a first elongated fluid passageway 58 between baffle first edge 54 and the interior wall of shell 10 and a second passageway 60 that is elongated and spaced between baffle second edge 56 and the opposed interior wall of shell 10. Baffle 48 has an upper surface 62 and a lower surface 64. As seen in FIG. 2, baffle 48, when observed in a vertical plane taken perpendicular the length of shell 10, and thereby perpendicular to the length of the elongated baffle is slightly inclined relative to the horizontal. A dotted line 66 illustrates the horizontal and the angle "A" illustrates the angular tilt of baffle 48 relative to the horizontal. This angular tilt of baffle plate 48 is an important feature of the invention and results in first longitudinal fluid passageway 58 being elevationally positioned above second longitudinal fluid passageway 60.

When hot gases are introduced into the firetube they flow first into burner leg 18, through loop 22 and out through stack leg 20 to heat the firetube and this heat is conveyed to heat transfer bath 36 surrounding the firetube. The heated bath liquid rises against the bottom surface 64 of baffle 48 and, due to the inclination of the baffle, flows to the right as seen in FIG. 2 and upwardly, as indicated by arrow 68 through first longitudinal passageway 58 into the upper portion of the interior of shell 10. The upward flow of heated bath fluid 36 results in a downward placement of the cooler heat transfer liquid in the upper portion of the vessel that passes downwardly through the second elongated fluid passageway 60 as indicated by arrow 70. More specifically, the cooler heater transfer bath liquid in the upper portion moves gravitationally downwardly to the upper surface 62 of baffle 48 and flows generally horizontally to the left and downwardly as indicated by arrow 70 through second passageway 60.

Baffle 48 that provides two elongated flow passageways, one of which is elevationally positioned above the other, results in an organized flow convection pattern within the interior of vessel 10.

This circulation pattern develops rapidly once a flame is established within firetube 18, 20 and continues until the flame is extinguished. Modeling of the process using fluid dynamic software has shown that the heat transfer rate from firetube 18, 20 to process coils 18 can expect to be improved by as much as nine percent (9%) in some applications.

The specific angle "A" by which baffle 18 is inclined can be such as about 2.5° and can vary from about 2° to about 10°. Generally, increasing the baffle angle improves the circulation of the fluid bath however, increasing the baffle angle also requires more dramatic rearrangement of the configuration of the firetube 18, 20 and the process coil 38. Baffle 48 should extend essentially across most of the interior diameter of shell 10 so that passageways 58 and 60 are not excessively wide.

Figure 4:
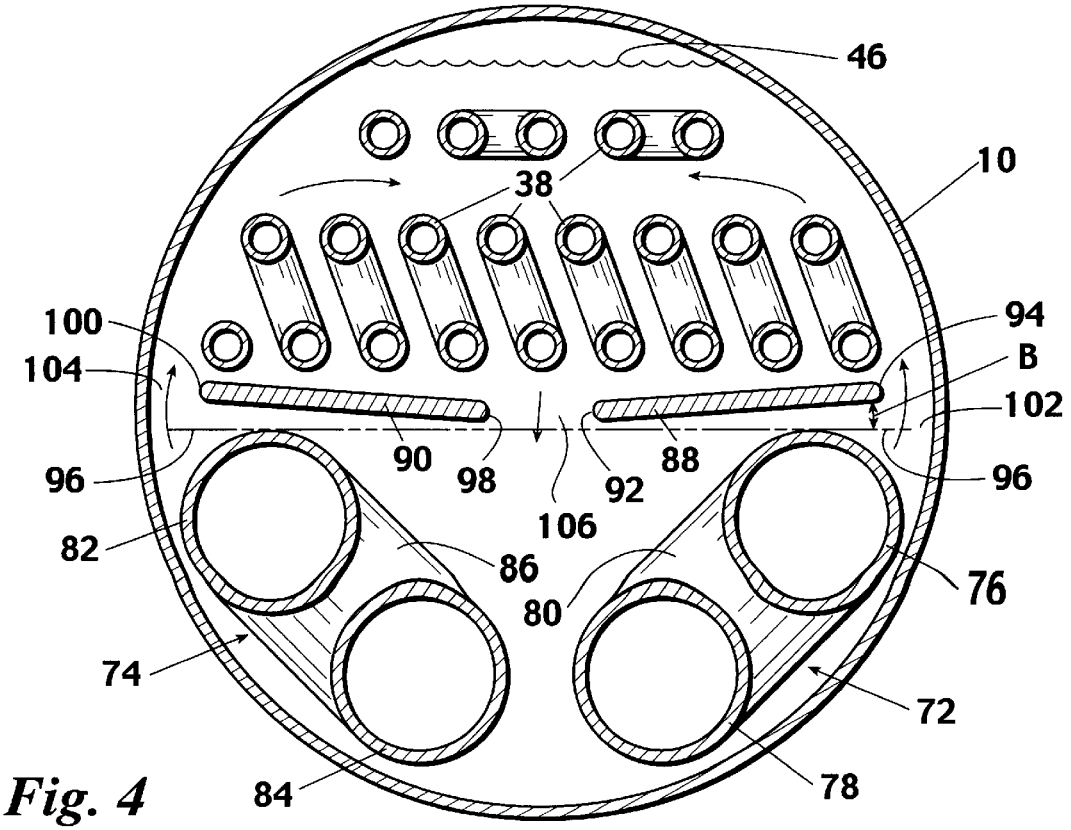
FIG. 4 is an elevational cross-sectional view as shown in FIG. 2 but showing an alternate arrangement wherein the shell contains two elongated U-shaped heater tubes and showing the use of two separate longitudinal baffles to establish convection flow patterns within the shell by which improved heat transfer is obtained.

FIGS. 1 and 2 illustrate an embodiment of the invention utilizing a single firetube in the form of an elongated U-shaped tube having a burner leg 18 and a stack leg 20 connected by an integral U-shaped portion 22. FIG. 4 is a cross-sectional view similar to FIG. 2 and as would be taken in the same location of a cylindrical shell of the type shown in FIG. 1 but wherein instead of a single firetube, two elongated U-shaped firetubes generally indicated by the numerals 72 and 74 are employed. Each of firetubes 72 and 74 is positioned in the lower portion of a shell 10. Firetube 72 includes a burner leg 76 and a stack leg 78 with an integral interconnecting U-shaped portion 80 that is located adjacent the second end of shell 10. Positioned parallel to firetube 72 is second firetube 74 that correspondingly has a burner leg 82, a stack leg 84 and an interconnecting U-shaped portion 86.

The use of two gas fired firetubes in an indirect water bath heater as illustrated in FIG. 4 is a known technique particularly in the petroleum industry. The important difference however between the known technology and that of FIG. 4 is the provision of a first baffle 88 and a second baffle 90, first baffle 88 being elevationally positioned between first firetube 72 and process coils 38 and second baffle 90 being elevationally positioned between second firetube 74 and the process coils. Each of baffles 88 and 90 is elongated and extend at least substantially the full interior length of shell 10 and typically in end-to-end relationship are horizontal when shell 10 is an elongated horizontal cylindrical vessel. First baffle 88 has an inner edge 92 and an outer edge 94. In a vertical cross-section perpendicular the longitudinal length of the shell and correspondingly baffle 88, as illustrated in FIG. 4, baffle 88 is inclined relative to the horizontal indicated by horizontal line 96 and angle "B". In like manner, second baffle 90 has an inner edge 98 and an outer edge 100 with the outer edge being elevationally higher than inner edge 18 relative to horizontal line 96.

The baffle arrangement of FIG. 4 provides three elongated flow passageways communicating the lower with the upper interior portion of shell 10, that is, a first outer passageway 102 between the outer edge 94 of baffle 98 and the interior wall of the shell; a second outer passageway 104 between the outer edge 100 of baffle 90 and the interior wall of the shell, and a third elongated central passageway 106 between the inner edges 92 and 98 of baffles 88 and 90. Heat conducting liquid that fills the interior shell 10 is heated by firetubes 72 and 74 to cause rising convection currents. Heat provided by burner legs 76 of first firetube 72 causes the liquid to rise against the bottom surface of baffle 88 and to flow outwardly and upwardly, as indicated by the arrows, through first outer passageway 102. In like manner, liquid heated by burner leg 82 of second firetube 74 causes convection flow of the heat transfer liquid against the bottom surface of second baffle 90 and due to the inclination of the baffle, the heated flow is diverted towards the outer peripheral wall of shell 90 and rises, as indicated by the arrow, through passageway 104. At the same time, the heat transfer liquid in the upper half of the shell is cooled by process coil 38, that is, as fluid flows through process coils heat is extracted from the heat transfer liquid, cooling the heat transfer liquid and the cooler heat transfer liquid, by convection flow, tends to gravitate downwardly against the upper surfaces of baffles 88 and 90, and due to their inclination, to flow inwardly towards elongated central passageway 106, the flow direction being indicated by the arrow, into the lower portion of shell 10.

Thus, baffles 88 and 90 function to organize convection flow currents created by the two firetubes illustrated in FIG. 4 to create convection current flow paths that increase the heat transfer rate between firetubes 72 and 74 and process coils 38. Since the volume of convection liquid flow downwardly through passageway 106 is equal to the total of the volume of liquid flow upwardly through passageways 102 and 104, passageway 106 should preferably be approximately twice the horizontal width as passageways 102 and 104.

Figure 5:
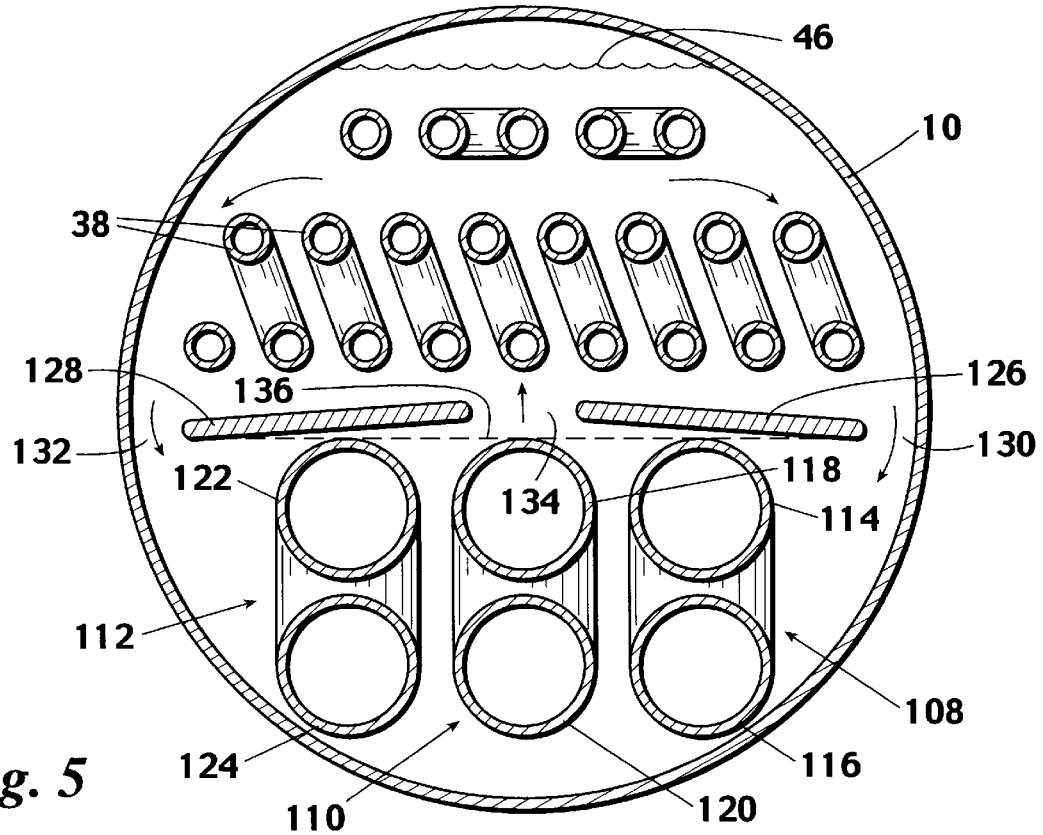
FIG. 5 is an elevational cross-sectional view similar to FIG. 2 but showing the arrangement wherein three separate U-shaped heater tubes are employed and wherein two baffles are utilized to establish convective flow patterns within the heat transfer liquid.

FIG. 5 is another alternate embodiment of the invention. FIG. 5, like FIG. 4, shows essentially a known type of heater design and more specifically, a known type of indirect water bath heater design, that includes three firetubes designated generally by the numerals 108, 110 and 112. Firetube 108 has a burner leg 114 and a stack leg 116. Firetube 110 has a burner leg 118 and a stack leg 120 and firetube 112 has a burner leg 122 and a stack leg 124. The stack and burner legs are connected by integral U-shaped portions as has been described. This type of heater uses three separate burners (not seen) that are connected to the three burner legs and stacks are connected to the stack legs as previously described.

The uniqueness of FIG. 5 is the provision of two baffles, that is first baffle 126 and second baffle 128. The baffles, as was described with reference to FIG. 4, are elongated and extend substantially the full interior length of shell 10 and are positioned between firetubes 108, 110 and 112 and process coil 38. Each of the baffles has longitudinal edges as has been previously described and the baffles are positioned to provide flow passageways 130, 132 and 134. Outer flow passageway 130 and 132 are between the outer edge of baffles 126 and 128 and the interior wall of shell 10 and central passageway 134 is between the inner edges of baffles 126 and 128. In the arrangement of FIG. 5, baffles 126 and 128 are each, in a cross-section taken perpendicular the longitudinal length of shell 10, inclined to the horizontal, a horizontal line being indicated by the numeral 136. As contrasted with the directions of inclination of baffles 126 and 128 in FIG. 5 are opposite to the directions of inclination of baffles 88 and 90 in FIG. 4. That is, in FIG. 5 baffles 126 and 128 are inclined relative to the horizontal so that their inner edges are higher than their outer edges causing convection fluid to flow upwardly through center longitudinal passageway 134 and downwardly through the opposed outer longitudinal passageways 130 and 132 in the direction indicated by the arrows. The convection current flow in FIG. 5 is organized so as to increase the heat transfer between the firetubes in the lower portion of the vessel and the process coil in the upper portion of the vessel.

Thus, FIGS. 2, 4 and 5 illustrate how the system of this invention may be employed either with a single firetube or with multiple firetubes by the use of baffles to create positive convection flow patterns to achieve significantly increased heat transfer rates.

The systems illustrated herein including a single loop firetube of FIG. 2, two firetubes of FIG. 4 and three firetubes of FIG. 5, in conjunction with inclined elongated baffles, result in significantly improved circulation efficiencies within an indirect water bath heater. Any improvement in convection circulation efficiency of the heat transfer liquid will improve the efficiency of the heater system and even a small percent increase in efficiency can result in a significant reduction in fuel costs. When increased heat transfer efficiency is achieved the size of a heater to achieve a predetermined heating rate can result in reduced initial equipment costs.

Figure 6:
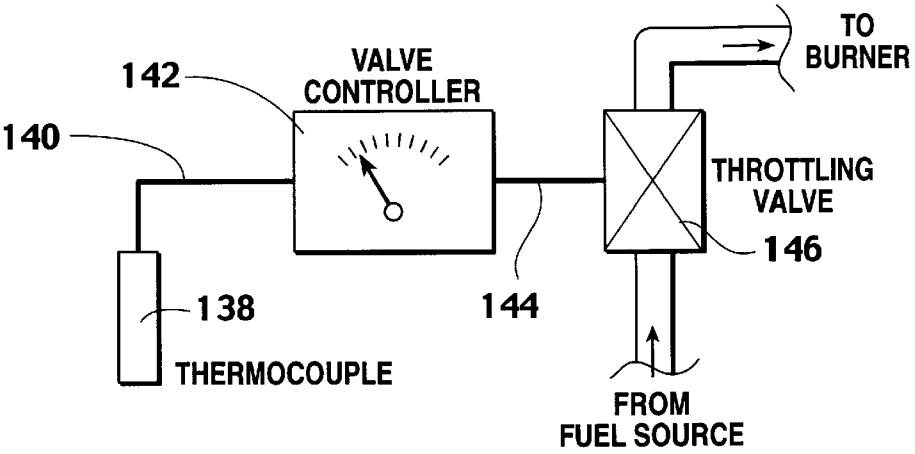
FIG. 6 is a rudimentary wiring diagram showing a thermocouple used to control a throttling valve that regulates gas flow to a burner that supplies heat to a firetube.

Further, heater performance improvements can be gained by the use of an improved bath temperature control system made possible by the systems disclosed herein. In the past, indirect water bath heaters have typically employed pneumatic controllers that operate in an "ON/OFF" mode. That is, most existing indirect water bath heaters utilize control systems that turn the gas supply to a burner on or off in response to the temperature of the heat transfer liquid. This "ON/OFF" control system reduces the efficiency of the heater. In the improved system of this invention a thermocouple is installed to detect temperature of the heat transfer liquid. A good location for such thermocouple is on the centerline between the heater burner leg and stack leg, as illustrated in FIG. 2. The thermocouple, in conjunction with a commercially available control system, provides an electrical signal indicative of the constantly monitored temperature of the heat transfer liquid. FIG. 6 is a rudimentary diagram showing the use of thermocouple 138 connected by conductor 140 to a valve controller 142 that, in turn, is connected by conductor 144 to an electrically controlled throttling valve 146. Valve 146 functions to throttle the quantity of fuel delivered from a source to a burner, or burners, that are employed to provide hot combustion gases fed to a burner leg of a firetube, such as burner leg 18 of FIG. 2, or to the burner legs of the embodiments illustrated in FIGS. 4 and 5. In contrast to most commonly used existing systems the diagram of FIG. 6 illustrates that a control system may be employed utilizing a valve controller 142 providing an output signal on conductor 144 to control throttle valve 146 in a way that the quantity of heat supplied by a burner to a heater or heaters can be more or less continuously varied. The throttling-type temperature controller achieves an improved burner firing rate that ideally can approach a steady state rate. By reducing burner cycling the heat transfer efficiency of the systems described herein can be improved up to five percent (5%).

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity, it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed:

1. An apparatus for heating process fluids comprising:

an elongated horizontal shell having a width and a length and having a heat transfer liquid therein;

an elongated firetube positioned within a lower portion of said shell by which heat is applied to said heat transfer liquid;

an elongated process coil within an upper portion of said shell through which process fluids are circulated; and an elongated baffle within said shell between said firetube and said coil, the baffle having a width less than said shell providing opposed longitudinal first and second flow passageways communicating said shell lower and upper portions, the baffle being at least generally horizontal from a first to an opposed second end and being inclined to the horizontal in a vertical plane taken perpendicular to its length whereby said first passageway is elevationally higher than said second passageway.

2. Apparatus for heating process fluids according to claim 1 wherein said shell is cylindrical with opposed ends defining said length and cylindrical sidewalls defining said width.

3. Apparatus for heating process fluids according to claim 2 wherein said baffle is of a length from said first to said second end at least substantially equal to said shell length.

4. Apparatus for heating process fluids according to claim 1 wherein said firetube has an inlet end communicating with a first end of said shell through which hot gases of combustion enter and an outlet end extending exteriorly of said shell by which the gases of combustion are exhausted.

5. Apparatus for heating process fluids according to claim 4 wherein said firetube outlet end extends through said first end of said shell, said firetube being U-shaped in a horizontal plane.

6. Apparatus for heating process fluids according to claim 1 having a first and a second elongated firetube spaced horizontally adjacent and paralleled to each other within said shell lower portion and wherein said baffle is in the form of first and second elongated paralleled baffles, said first baffle being between said first firetube and said process coil and said second baffle being between said second firetube and said process coil, each of said first and second baffles being inclined to the horizontal in a plane of each taken perpendicular to its length.

7. Apparatus for heating process fluids according to claim 6 wherein said elongated paralleled first and second baffles are spaced apart from each other providing a central elongated flow passageway therebetween communicating the interior of said shell below said baffles with the interior of said shell above said baffles and wherein each of said first and second baffles is, in a vertical plane taken perpendicular the length of said baffles, inclined upwardly in the direction of said elongated central passageway.

8. Apparatus for heating process fluids according to claim 1 having three elongated horizontally disposed firetubes spaced paralleled to each other within said shell lower portion providing a first outer elongated firetube, a second outer elongated firetube and an intermediate elongated firetube positioned between the first and second outer firetubes and wherein said baffle is in the form of first and second elongated baffles, the first baffle being positioned above said first outer elongated firetube and the second baffle being positioned above said second outer elongated firetube and wherein said first and second baffles are spaced apart from each other providing a central elongated flow passageway therebetween communicating the interior of said shell below baffles with the interior of said shell above said baffles, the central elongated flow passageway being elevationally above said intermediate elongated firetube and wherein each of said first and second baffles is, in a vertical plane taken perpendicular the length of said baffles, inclined upwardly in the direction towards said elongated central passageway.

9. A method of heating a process fluid comprising:

heating a heating transfer liquid in an elongated horizontal shell by means of at least one elongated firetube positioned within a lower portion of said shell;

circulating process fluid through an elongated, generally horizontal coil of heat conducting pipe positioned within an upper portion of said shell and submersed within said heat transfer liquid; and directing the convection flow of heat transfer liquid from said lower to said upper portion of said shell by an elongated baffle supported within said shell between said firetube and said coil to form opposed longitudinal first and second flow passageways at opposed longitudinal edges of said baffle, the baffle being inclined to the horizontal in a vertical plane taken perpendicular to its length whereby said first passageway is elevationally higher than said second passageway, convection flow causing heat transfer liquid to flow upwardly through said first elongated passageway and downwardly through said second elongated passageway.

10. A method of heating a process fluid according to claim 9 wherein said step of heating a heat transfer liquid is accomplished by an elongated firetube having an inlet end communicating with a first end of said shell through which hot gases of combustion enter and an outlet end extending exteriorly of shell by which the gases of combustion are exhausted.

11. A system for heating a process fluid comprising:

an elongated horizontal shell having therein a heat transfer liquid, an elongated horizontal firetube and an elongated horizontal coil of heat conducting pipe through which process fluid passes and a baffle between said firetube and said coil forming an elongated higher elevation up flow passageway and an opposed elongated lower elevation down flow passageway whereby convection flow of heat transfer liquid is continually channeled from said shell lower portion upwardly through said higher elevation up flow passageway into said shell upper portion, past said coil and from shell upper portion downwardly through said lower elevation down flow passageway into said shell lower portion.

* * * * *

UNITED STATES PATENT AND TRADEMARK OFFICE

CERTIFICATE OF CORRECTION

PATENT NO. : 5,921,206
DATED : July 13, 1999
INVENTOR(S) : Gary W. Sams

It is certified that error appears in the above-identified patent and that said Letters Patent is hereby corrected as shown below:

Title page,
Item [73], Assignee, replace "Bank" with -- Tank --.

Signed and Sealed this

Fourth Day of February, 2003

JAMES E. ROGAN
*Director of the United States Patent and Trademark Office*